US008387624B1

(12) United States Patent
Ducker et al.

(10) Patent No.: US 8,387,624 B1
(45) Date of Patent: Mar. 5, 2013

(54) HOOKAH SUSPENSION ASSEMBLY

(76) Inventors: Brett Franklin Ducker, Coral Springs, FL (US); Andrew Leslie Ducker, Jr., Charlotte, NC (US); Andrew Leslie Ducker, III, Coral Springs, FL (US)

( * ) Notice: Subject to any disclaimer, the term of this patent is extended or adjusted under 35 U.S.C. 154(b) by 0 days.

(21) Appl. No.: 12/930,624

(22) Filed: Jan. 12, 2011

(51) Int. Cl.
*A24F 25/00* (2006.01)
*A24F 13/00* (2006.01)
*A24F 17/00* (2006.01)

(52) U.S. Cl. ..... 131/329; 220/660; 446/486; 248/318

(58) Field of Classification Search ..... None
See application file for complete search history.

(56) References Cited

U.S. PATENT DOCUMENTS 2,064,826 A * 12/1936 Gabriel ..... 220/660
3,915,419 A * 10/1975 Brown et al. ..... 248/318
4,561,547 A * 12/1985 Estwanik, III ..... 211/14
4,612,219 A * 9/1986 Tengs et al. ..... 428/8
5,503,587 A * 4/1996 Mellen ..... 446/486

* cited by examiner

*Primary Examiner* — Richard Crispino
*Assistant Examiner* — Phu Nguyen
(74) *Attorney, Agent, or Firm* — Frank L. Kubler

(57) ABSTRACT

An apparatus includes a hookah having a bottom surface, hookah hose and a hookah bowl; a hookah suspension assembly for containing and suspending the hookah from an elevated structure; a hookah support structure on which a bottom surface of the hookah can rest; a number of flexible support members each engaging the support structure; a guide ring; the support members extending upwardly from the support structure to and engaging the guide ring preventing the guide ring from sliding down the support members below a predetermined point and forming a circumferential series of the support members, the support members extending further upwardly from the guide ring and converging above the guide ring for engaging a suspension member secured to an elevated structure; so that the hookah and the hookah suspension assembly is elevated and suspended and the hookah is accessible for use and so that the hookah bowl is accessible between the support lines.

18 Claims, 12 Drawing Sheets

HOOKAH SUSPENSION ASSEMBLY

BACKGROUND OF THE INVENTION

1. Field of the Invention

The present invention relates generally to the field of hookahs and hookah supplies and accessories. More specifically the present invention relates to a hookah suspension assembly for securely and attractively containing and suspending a hookah from an elevated structure while providing operational access so that the hookah can be used while suspended. The assembly includes a hookah support panel on which the bottom surface of a hookah can rest, several flexible support lines each passing through a corresponding one of a circumferential series of support panel holes around the support panel perimeter and at least some of the lines have a panel support structure to support the support panel and a hookah resting on the support panel, the lines extending upwardly from the support panel to a guide ring where the support lines each pass through a corresponding one of a circumferential series of guide ring holes in the guide ring and at least one of the support lines preferably including a guide ring support structure preventing the guide ring from sliding down the lines beyond a desired position, and the lines then extending upwardly from the guide ring and converging above the guide ring where they engage a suspension member such as a hook secured to an elevated structure such as a ceiling, so that the hookah and assembly are elevated and suspended and the hookah is accessible for use. The hookah tobacco bowl is contained within the assembly below where the support lines converge and is accessible between the lines. A ribbon or other flexible member preferably is wrapped around the circumferential series of support lines generally perpendicular to the lines and tightened to pull the lines inwardly against the side surfaces of the hookah to grip and hold the hookah securely within the assembly, and then is tied or otherwise fastened in the wrapped position.

A guide panel preferably is provided spaced upwardly from the guide ring, and preferably is smaller in diameter than the guide ring, and each support line passes through a corresponding one of a circumferential series of holes about the perimeter of the guide panel before converging above the guide panel. As a result, the hookah is attractively displayed and secured against tipping over and breaking, thereby also freeing floor or table space where the hookah otherwise would rest, and is readily accessible for use.

A balancing weight preferably is provided for being removably secured to or suspended from an edge of the support panel to counterbalance the laterally extending weight of the hookah hose.

The support panel, the guide ring and the guide panel each may have any desired perimeter shape, including but not limited to circular, elliptical, square, rectangular and triangular, and can be a solid panel, a grid, a mesh, intersecting members or any other support structure.

2. Description of the Prior Art

Hookahs have existed for at least 423 years. They have been placed on any of a variety of support surfaces such as on a table or on the ground. A problem has been that hookahs are generally tall and narrow and made of glass, so that they are easy to knock over, and when knocked over they readily break.

The only prior hookah containment device known to applicant is that of Mehio, U.S. Pat. No. 7,404,405, issued on Jul. 29, 2008. Mehio discloses what is termed a portable hookah system and hookah containment device which is essentially an upright and free standing cylindrical cage formed apparently of stiff wires. The base of a hookah is seated in and engaged by the cage lower end, and the cage is sized so that when a hookah is inside the cage the bowl protrudes through and above an opening in the top of the cage. The cage has a pivoting wire carrying handle, for transporting the cage and hookah to a support surface on which the cage can rest.

It is thus an object of the present invention to provide a hookah suspension assembly for securely containing and suspending a hookah from an elevated structure such as a ceiling while providing operational access to the hookah, so that the hookah cannot be knocked over and broken and also does not require table or floor space, and so that the hookah can be used while suspended.

It is another object of the present invention to provide such a hookah suspension assembly which is aesthetically pleasing and which showcases the hookah.

It is still another object of the present invention to provide such a hookah suspension assembly which readily collapses into a compact configuration when the assembly is removed from suspension and the hookah is removed from the assembly.

It is finally an object of the present invention to provide such a hookah suspension assembly which is simple in design, sturdy and reliable, can be constructed in a variety of styles which can include fiber optic filaments, and is inexpensive to assemble.

SUMMARY OF THE INVENTION

The present invention accomplishes the above-stated objectives, as well as others, as may be determined by a fair reading and interpretation of the entire specification.

A hookah suspension assembly is provided for containing and suspending a hookah from an elevated structure, the hookah having a hookah bowl and a hookah hose, the assembly including a hookah support panel on which a bottom surface of a hookah can rest, the support panel having a circumferential series of support panel holes; a number of flexible support lines each passing through a corresponding one of the support panel holes; a guide ring having a circumferential series of guide ring holes in the guide ring; and at least one of the support lines having a panel support structure for supporting the support panel, the support lines extending upwardly from the support panel to the guide ring where the support lines each pass through a corresponding one of the guide ring holes in the guide ring to form a circumferential series of the support lines and at least one of the support lines includes a guide ring support structure preventing the guide ring from sliding down the support lines below a predetermined point, the support lines extending further upwardly from the guide ring and converging above the guide ring for engaging a suspension member secured to an elevated structure; so that the hookah suspension assembly can be elevated and suspended.

The hookah suspension preferably additionally includes a flexible member wrapped around the circumferential series of support lines generally perpendicular to the support lines and tightened to pull the support lines inwardly against side surfaces of the hookah to grip and hold the hookah securely in the assembly, and then is tied or otherwise fastened in the wrapped and tightened position. The flexible member preferably includes a ribbon. The guide ring support structure preferably includes one of: a knot in the given line and a decorative ring fitted and secured around the line and extending radially outwardly from the given line to a diameter wider than the corresponding the guide ring hole. The support lines each optionally terminate below the support panel to form line lower ends.

At least one of the support lines preferably includes a panel support structure below and supporting the support panel, each panel support structure including one of a knot in the given support line and a ring fitted and secured around and extending radially outwardly from the given support line to be wider than the corresponding support panel hole. The support lines preferably are secured together where they converge above the guide ring. The support lines optionally terminate where they converge to form line upper ends. The support lines preferably are secured by being tied.

The hookah suspension assembly preferably additionally includes a guide panel spaced upwardly from the guide ring and below where the support lines converge, the guide panel having a circumferential series of guide panel holes; where each support line passes through a corresponding one of the guide panel holes. The guide panel preferably is smaller in diameter than the guide ring. Optionally only some of the support lines extend above the guide panel and converge, while other the support lines terminate substantially immediately above and are secured relative to the guide panel.

The hookah suspension assembly preferably additionally includes a balancing weight connected to an edge of the support panel for counterbalancing the weight of laterally hookah hose. The balancing weight preferably includes a hollow ball which can be opened to receive a suitable weight element, and the hollow ball is connected to a suspension member which is secured to a support line on substantially the opposite side of the hookah from the hookah hose, above the support panel.

The support lines preferably include braided ropes. The hookah suspension assembly preferably additionally includes at least one fiber optic filament extending along at least one of the support lines and connected to a light source which can project light through and illuminate the at least one fiber optic filament. The at least one fiber optic filament preferably is braided into one of the support lines. The light source preferably is a 12 volt or 110 volt control box fastened to the support panel. The at least one of the support lines optionally is a fiber optic filament. Fiber optic filaments may also be placed on other parts of the assembly such as the support panel, guide ring and guide panel.

An assembly preferably includes a hookah having a bottom surface, a hookah hose and a hookah bowl; a hookah suspension assembly for containing and suspending the hookah from an elevated structure; a hookah support structure on which a bottom surface of the hookah can rest; a number of flexible support members each engaging the support structure; a guide ring; the support members extending upwardly from the support structure to and engaging the guide ring preventing the guide ring from sliding down the support members below a predetermined point and forming a circumferential series of the support members, the support members extending further upwardly from the guide ring and converging above the guide ring for engaging a suspension member secured to an elevated structure; so that the hookah and the hookah suspension assembly is elevated and suspended and the hookah is accessible for use and so that the hookah bowl is contained within the hookah suspension assembly below where the support members converge and is accessible between the support lines.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
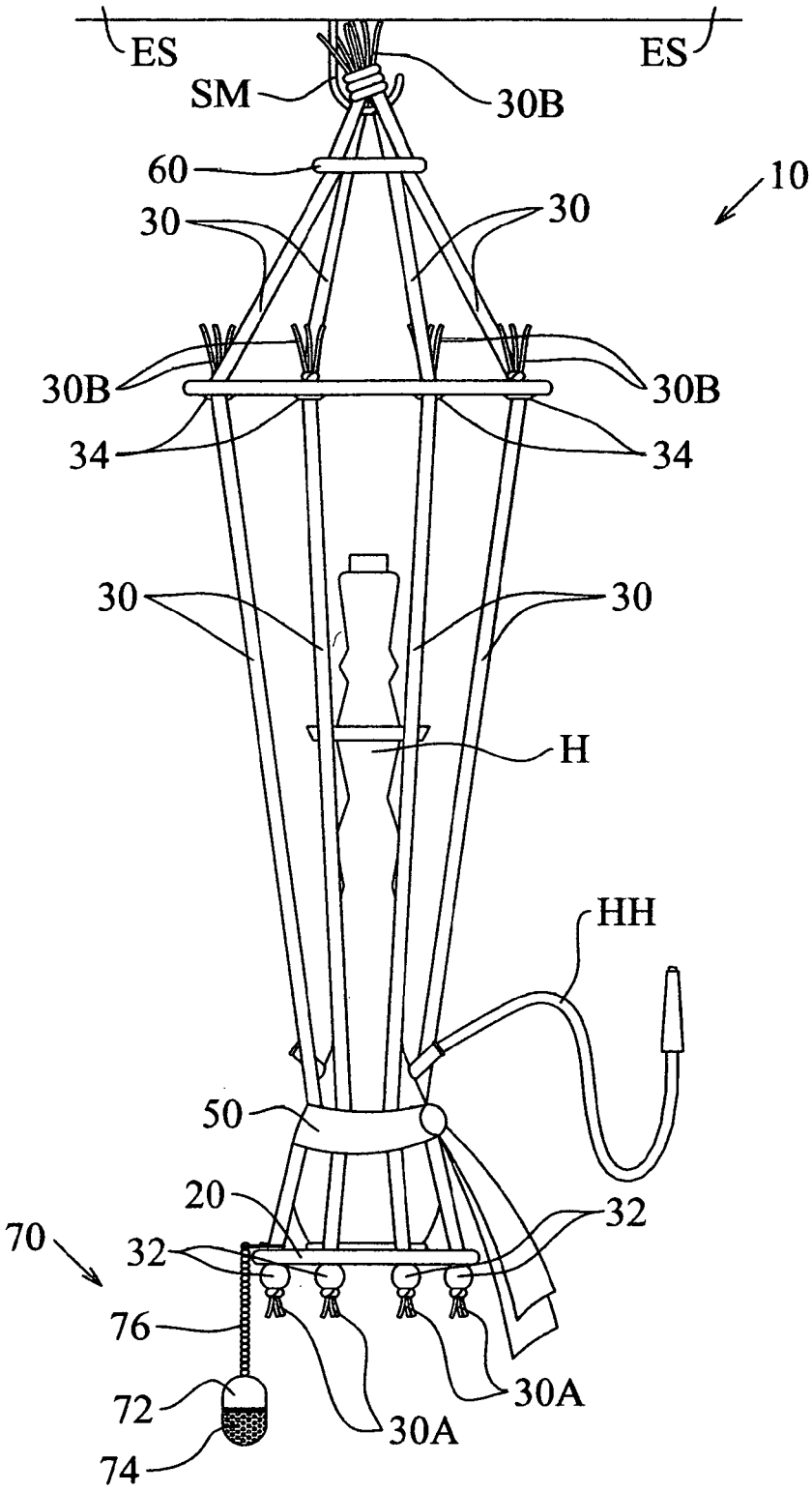
FIG. 1 is a front perspective view of the preferred hookah suspension assembly containing a hookah, with the hookah hose extending outwardly between support lines.
Figure 1A:
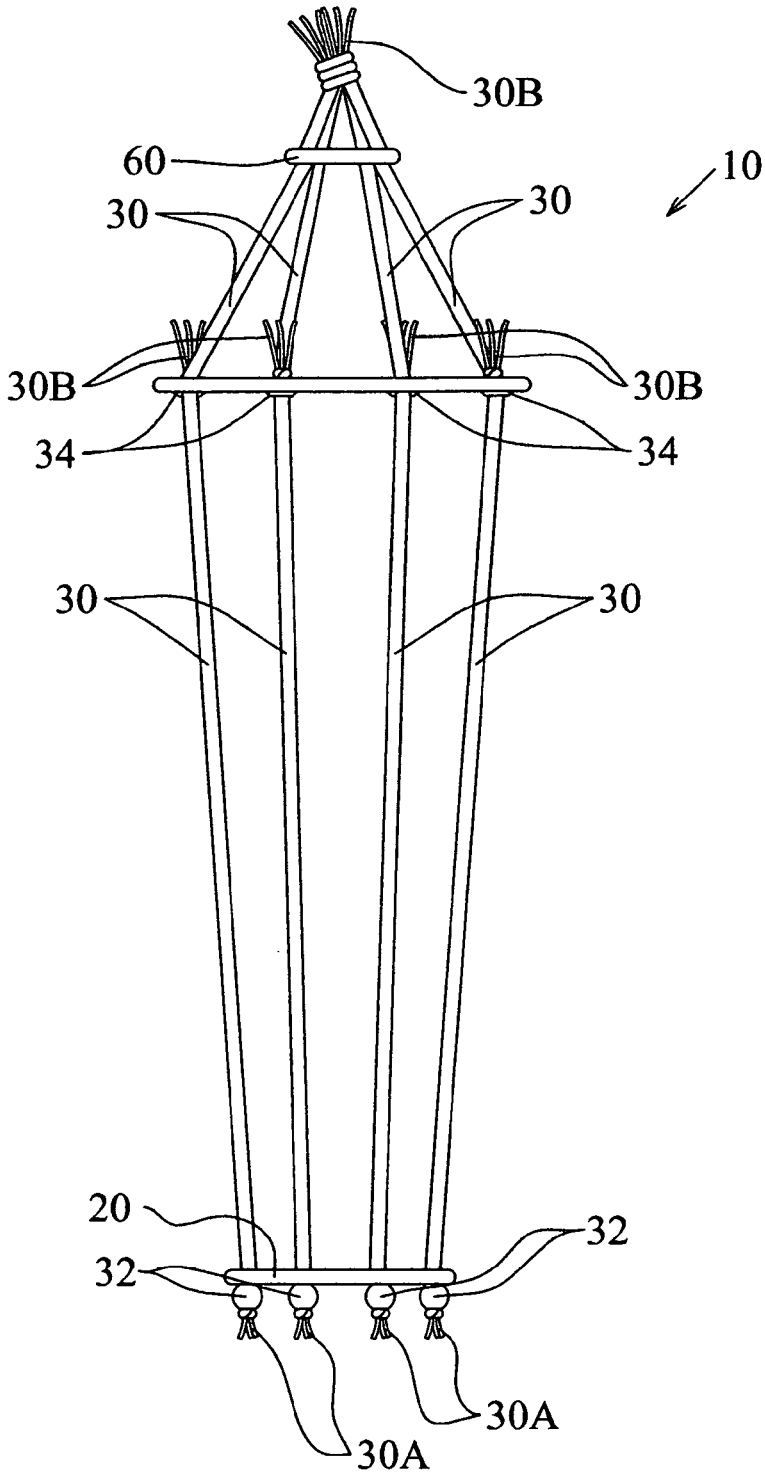

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-10A, a hookah suspension assembly 10 is disclosed for securely and attractively containing and suspending a hookah H from an elevated structure ES while providing operational access to the hookah H so that the hookah H can be used while suspended.

Figure 2:
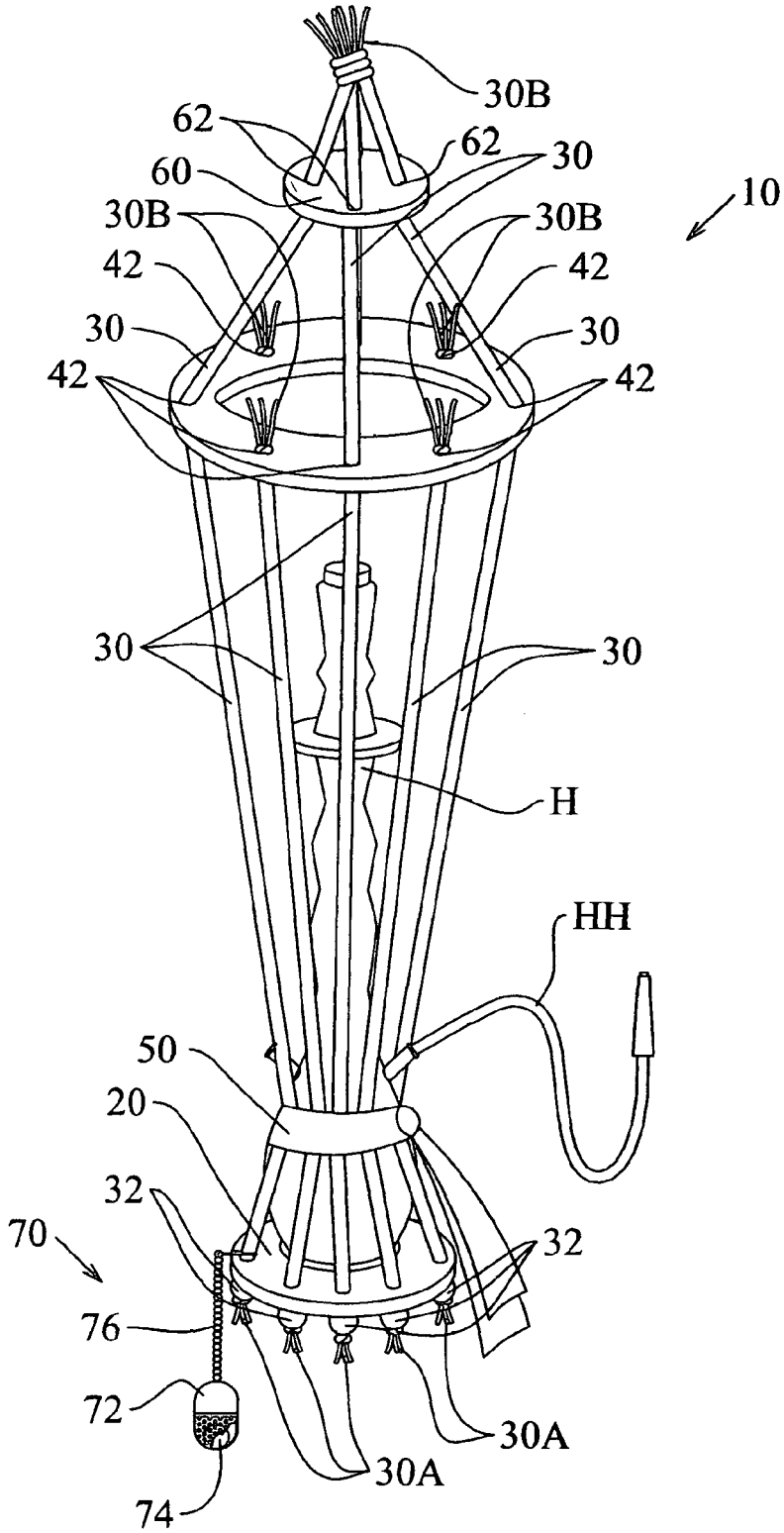
FIG. 2 is an upper perspective view of the assembly and hookah as shown in FIG. 1.
Figure 3:
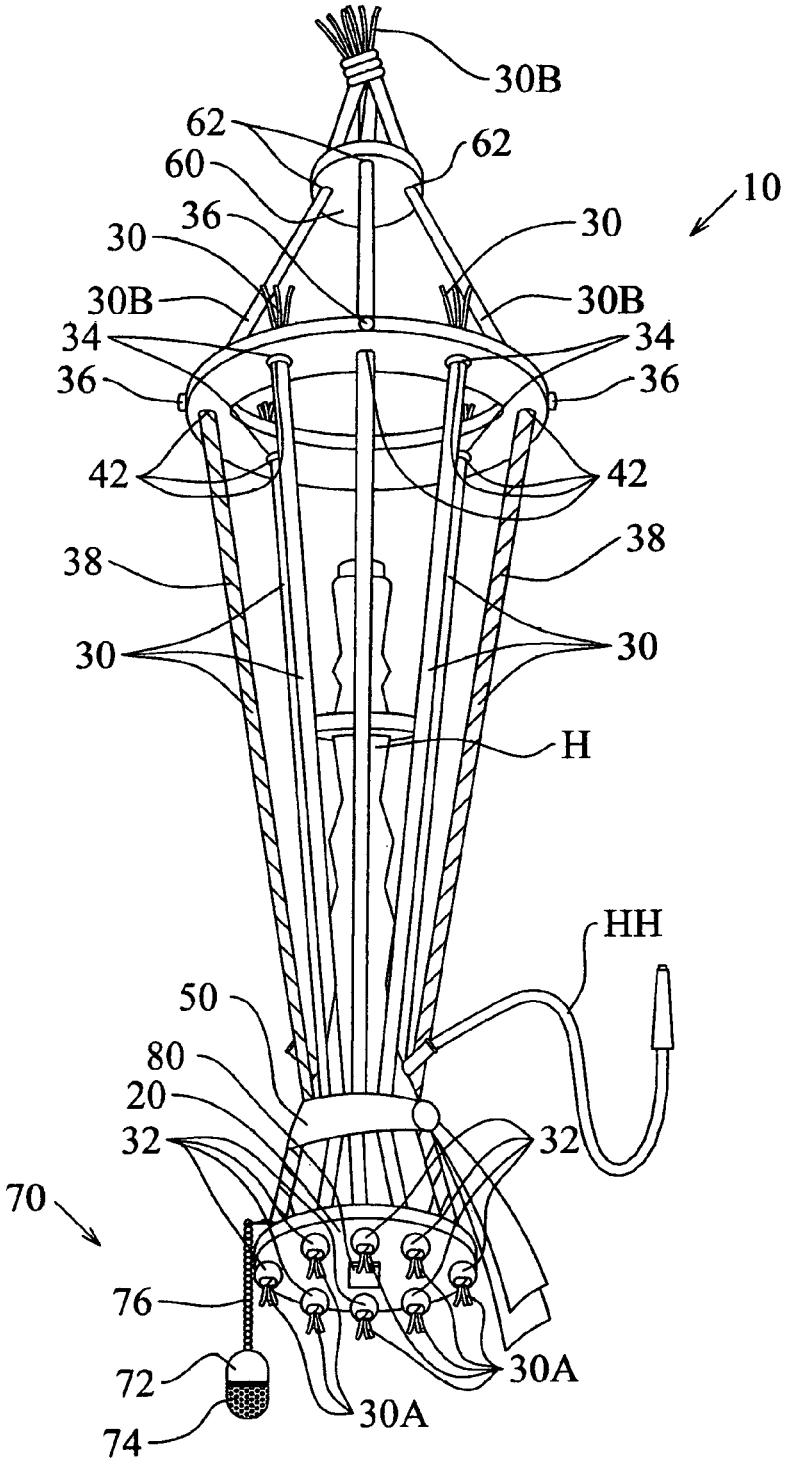
FIG. 3 is a lower perspective view of the assembly and hookah as shown in FIG. 1.
Figure 3A:
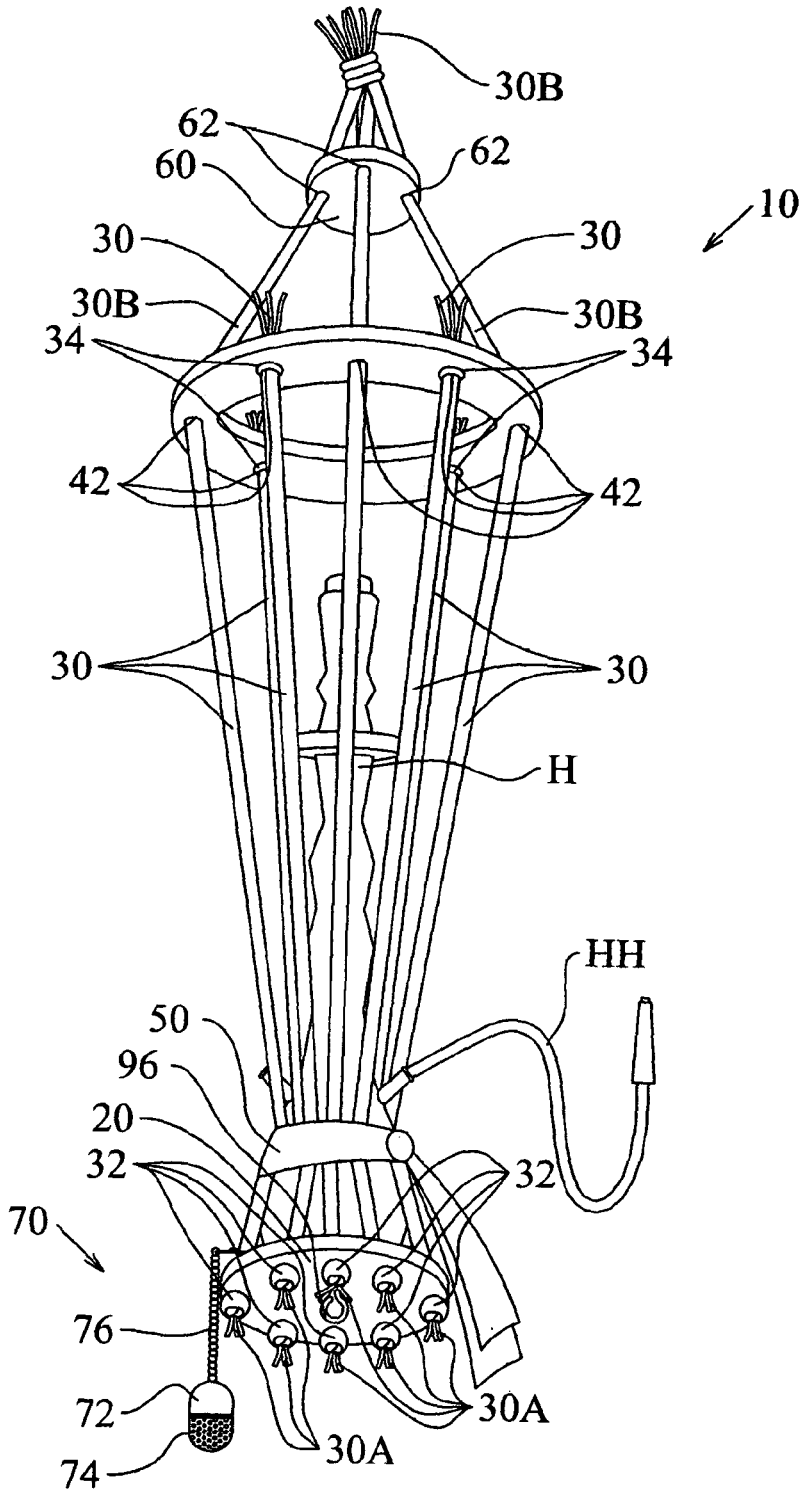
Figure 4:
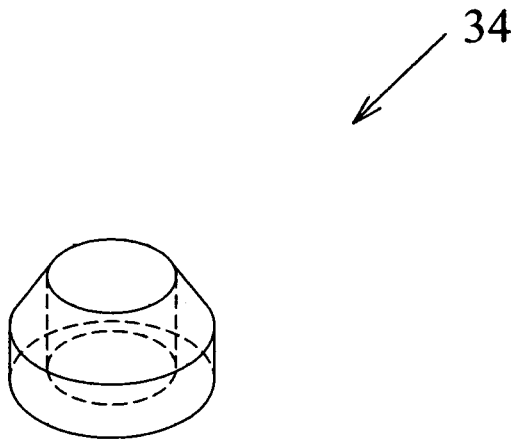
FIG. 4 is a bead supporting the guide ring.
Figure 5:
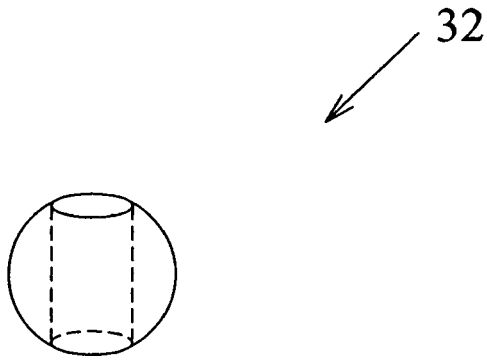
FIG. 5 is a bead supporting the support panel.
Figure 6A:
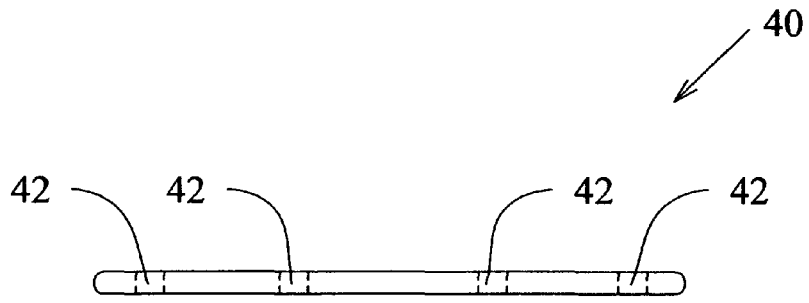
FIG. 6A is a edge view of the guide ring of FIG. 6.
Figure 6:
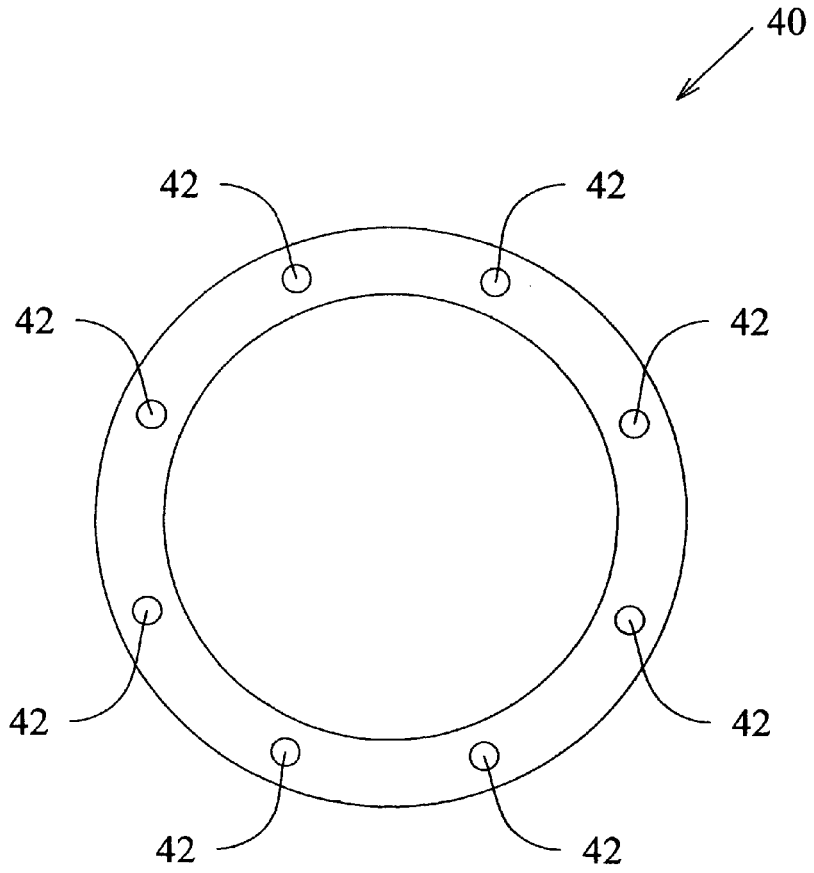
FIG. 6 a top view of the guide ring.
Figure 7A:
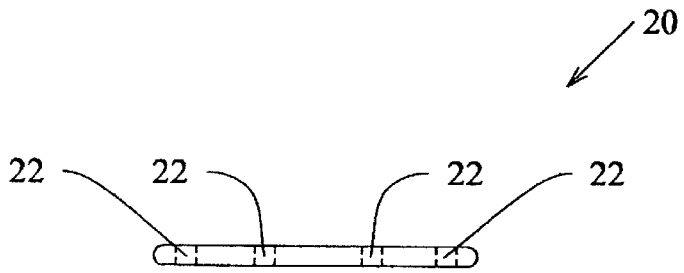
FIG. 7A is a edge view of the support panel of FIG. 7.
Figure 7:
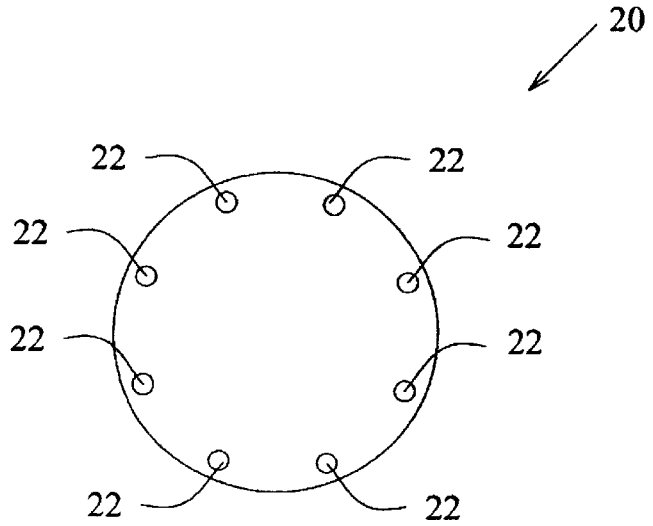
FIG. 7 is a top view of the support panel.
Figure 8A:
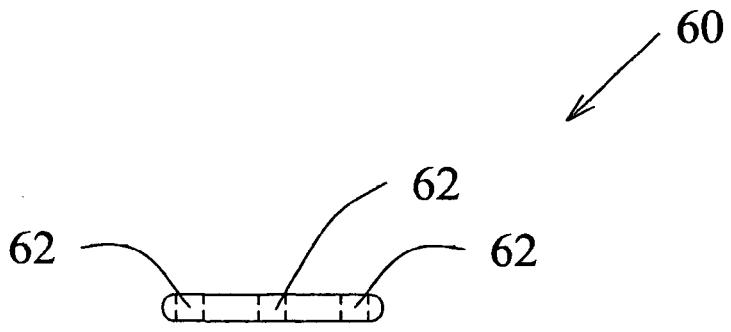
FIG. 8A is a edge view of the guide panel of FIG. 8.
Figure 8:
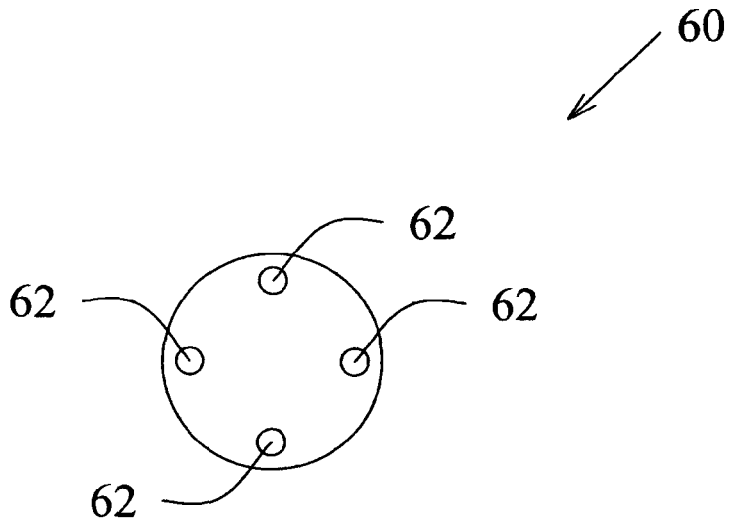
FIG. 8 is a top view of the guide panel.
Figure 9:
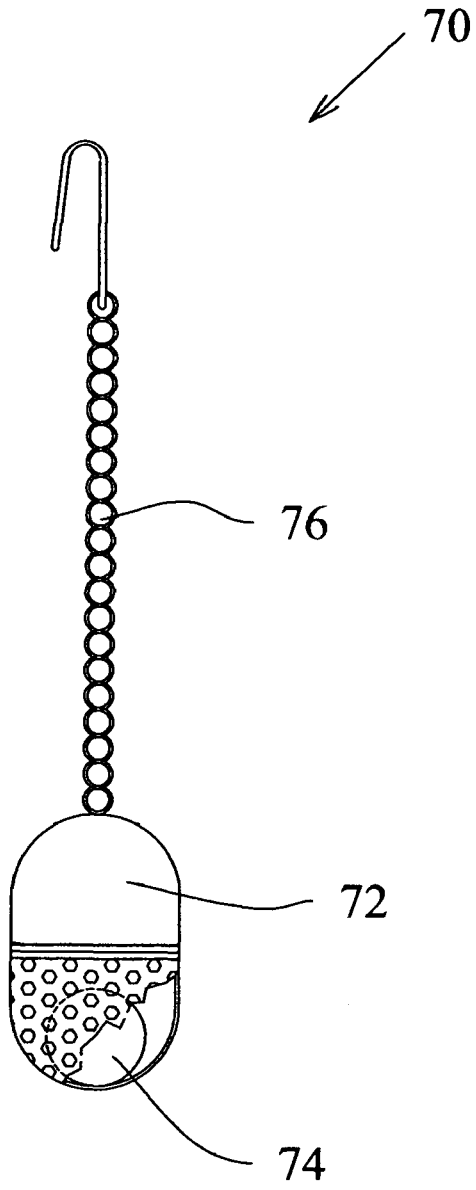
FIG. 9 is a side view of the preferred balancing weight including the ball and suspension chain.
Figure 10:
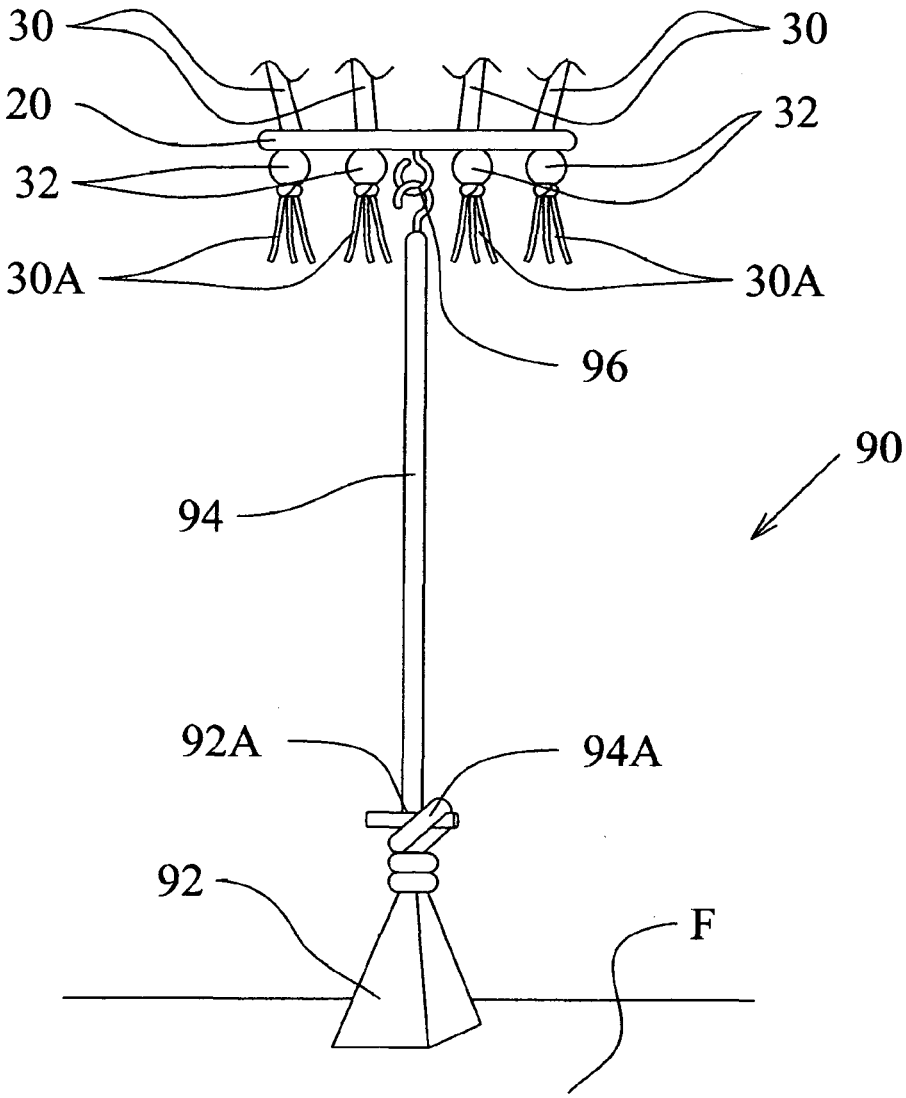
FIG. 10 is a side view of the assembly lower end showing the support panel and the preferred steadying weighted base.
Figure 10A:
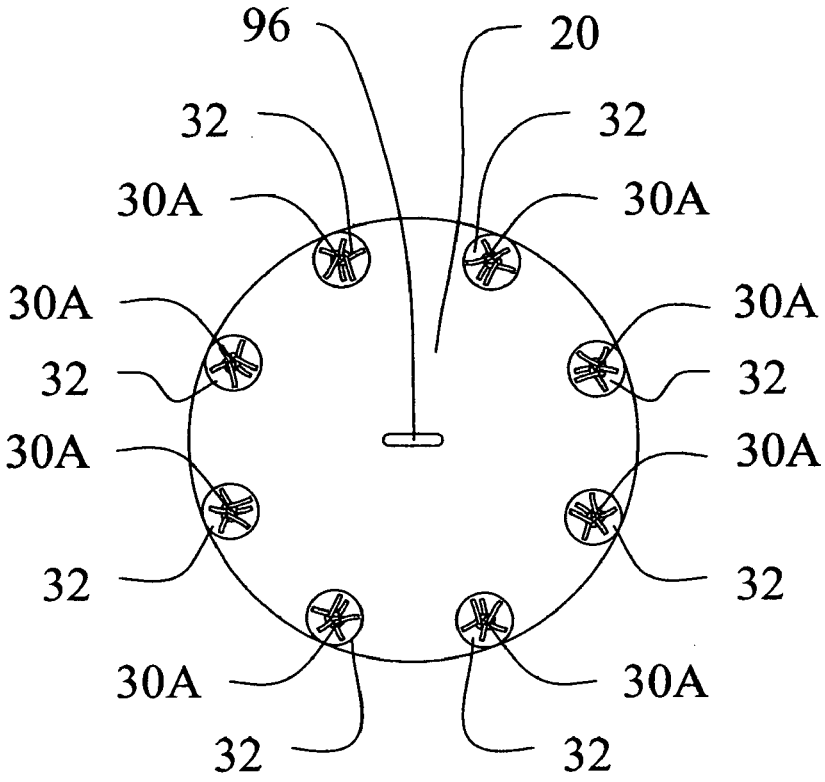
FIG. 10A is a bottom view of the hookah support panel, also showing the line lower ends and panel support structures.

The assembly 10 includes a hookah support panel 20 having a circumferential series of support panel holes 22 around the support panel 20 perimeter on which the bottom surface of a hookah H can rest, several flexible support lines 30 each passing through a corresponding one of the support panel holes 22 and at least some of the lines 30 have a panel support structure 32 to support the support panel 20 and a hookah H resting on the support panel 20. The support lines 30 extend upwardly from the support panel 20 to a guide ring 40 having a circumferential series of guide ring holes in the guide ring 40 where the support lines 30 each pass through a corresponding one of the guide ring holes 42 in the guide ring 40, and at least one of the support lines 30 including a guide ring support structure 34 preventing the guide ring 40 from sliding down the lines 30 beyond a desired position. The lines 30 then extend upwardly from the guide ring 40 and converge above the guide ring 40 and engage a suspension member SM such as a hook secured to an elevated structure ES such as a ceiling, so that the hookah H and assembly 10 are elevated and suspended and the hookah H is accessible for use. The hookah tobacco bowl HB is contained within the assembly 10 below where the support lines 30 converge and is accessible between the lines 30. A ribbon or other flexible member 50 preferably is wrapped around the circumferential series of lines 30 generally perpendicular to the lines 30 and tightened to pull the lines 30 inwardly against the side surfaces of the hookah H to grip and hold the hookah H securely within the assembly 10, and then is tied or otherwise fastened in the wrapped position. The guide ring support structures 34 each preferably include a knot in the given line 30 or a decorative ring or bead (as illustrated in FIGS. 1-3) fitted and secured around and extending radially outwardly from the line 30 so that the knot or decorative ring 34 is wider than the corresponding guide ring hole 42. A bead 34 is a ball such as of wood having a diametric hole through it.

The support lines 30 preferably each terminate immediately below the support panel 20 to form line lower ends 30A. At least one of the lines 30 preferably includes a panel support structure 32 below and supporting the support panel 20, each panel support structure 32 preferably including once again a knot in the given line 30 or a decorative ring or bead fitted and secured around and extending radially outwardly from the support line 30, so that the knot or decorative ring 34 is wider than the corresponding guide ring hole 42. The support lines 30 preferably are secured together where they converge above the guide ring 40 such as by being tied, and also preferably terminate where they converge to form line upper ends 30B.

A guide panel 60 preferably is provided spaced upwardly from the guide ring 40, and preferably is smaller in diameter than the guide ring 40, and each support line 30 passes through a corresponding one of a circumferential series of guide panel holes 62 about the perimeter of the guide panel 60 before converging above the guide panel 60. Where a guide panel 60 is provided, only some of the lines 30 optionally continue above the guide panel 60 and converge, while others may terminate at or immediately above the guide panel 60 where they are tied or are otherwise secured relative to and supported by the guide panel 60. As a result, the hookah H is attractively displayed and secured against tipping over and breaking, thereby also freeing floor or table space where the hookah H otherwise would rest, and is readily accessible for use.

A balancing weight 70 preferably is provided for being removably secured to or suspended from an edge of the support panel 20 to counterbalance the laterally extending weight of the hookah hose HH. The preferred balancing weight 70 includes a hollow ball 72 such as a tea egg which can be opened to receive a suitable balancing weight element 74 such as a lead weight, the ball 70 being connected to a balancing weight chain 76 which is tied around a support line 30 on the opposite side of the hookah H from the hose, immediately above the support panel 20. The hollow ball 70 preferably is formed of two hemispherical halves which releasably screw together.

A steadying weighted base 90 preferably is also provide where the assembly 10 is hung outdoors and is thus subject to pivoting in the wind. See FIG. 10. The steadying weighted base 90 preferably includes a steadying weighted base rope 94 secured to a hook fastened to the lower surface of the support panel 20, and a steadying weighted element 92 secured to the base rope lower end 94A of the base rope 94. The base element 92 as illustrated has a truncated pyramid shape with a T-shaped structure 92A projecting upwardly from its upper end to which the lower end of the base rope 94 can be tied.

The support lines 30 preferably are braided ropes. One or more fiber optic filaments 38 preferably are braided into each of the lines 30. The fiber optic filaments 38 are connected to a standard fiber optic light source 80 such as a 12 volt or 110 volt control box, secured to the lower surface of the support panel 20. It is preferred that the fiber optic filaments 38 be illuminated by the light source 80 in a series of different colors, and at low, medium and high intensity for each color. See FIG. 3. Alternatively the support lines 30 themselves can be one or more fiber optic filaments 38. Fiber optic filaments 38 may also be placed on other parts of the assembly such as the support panel 20, the guide ring 40 and guide panel 60. Light emitting diodes (LED's) 36 are also optionally connected to the assembly 10 wherever desired for aesthetic enhancement, and are also electrically connected to a control box.

The support panel 20, the guide ring 40 and the guide panel 60 each may have any desired perimeter shape, including but not limited to circular, elliptical, square, rectangular and triangular, and can be a solid panel, a grid, a mesh, intersecting members or any other suitable configuration for hookah support or support line guidance. It is also contemplated, as a less preferred and alternative, that the support lines 30 be rigid or resilient rather than flexible.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. A hookah suspension assembly for containing and suspending a hookah from an elevated structure, the hookah having a hookah bowl and a hookah hose, comprising:

a hookah support panel on which a bottom surface of a hookah can rest, said support panel having a circumferential series of support panel holes;

a plurality of flexible support lines each passing through a corresponding one of said support panel holes;

a guide ring having a circumferential series of guide ring holes in said guide ring;

at least one of said support lines having a panel support structure for supporting said support panel, said support lines extending upwardly from said support panel to said guide ring where said support lines each pass through a corresponding one of said guide ring holes in said guide ring to form a circumferential series of said support lines and at least one of said support lines comprises a guide ring support structure preventing said guide ring from sliding down said support lines below a predetermined point, said support lines extending further upwardly from said guide ring and converging above said guide ring for engaging a suspension member secured to an elevated structure;

such that said hookah suspension assembly can be elevated and suspended;

and a flexible member wrapped around the circumferential series of said support lines generally perpendicular to said support lines and tightened to pull said support lines inwardly against side surfaces of the hookah to grip and hold the hookah securely in the assembly, and then is tied or otherwise fastened in the wrapped and tightened position.

2. The hookah suspension assembly of claim 1, wherein said flexible member comprises a ribbon.

3. The hookah suspension assembly of claim 1, wherein said guide ring support structure comprises one of: a knot in the given said line and a decorative ring fitted and secured around said line and extending radially outwardly from the given said line to a diameter wider than the corresponding said guide ring hole.

4. The hookah suspension assembly of claim 1, wherein said support lines each terminate below said support panel to form line lower ends.

5. The hookah suspension assembly of claim 1, wherein at least one of said support lines comprises a panel support structure below and supporting said support panel, each said panel support structure comprising one of a knot in the given said support line and a ring fitted and secured around and extending radially outwardly from the given said support line to be wider than the corresponding said support panel hole.

6. The hookah suspension assembly of claim 1, wherein said support lines are secured together where they converge above said guide ring.

7. The hookah suspension assembly of claim 1, wherein said support lines terminate where they converge to form line upper ends.

8. The hookah suspension assembly of claim 6, wherein said support lines are secured by being tied.

9. The hookah suspension assembly of claim 6, additionally comprising a guide panel spaced upwardly from said guide ring and below where said support lines converge, said guide panel having a circumferential series of guide panel holes;

wherein each said support line passes through a corresponding one of said guide panel holes.

10. The hookah suspension assembly of claim 9, wherein said guide panel is smaller in diameter than said guide ring.

11. The hookah suspension assembly of claim 10, wherein only some of said support lines extend above said guide panel and converge, while other said support lines terminate substantially immediately above and are secured relative to said guide panel.

12. The hookah suspension assembly of claim 1, additionally comprising a balancing weight connected to an edge of said support panel for counterbalancing the weight of laterally, hookah hose.

13. The hookah suspension assembly of claim 12, wherein said balancing weight comprises a hollow ball which can be opened to receive a suitable weight element, and wherein said hollow ball is connected to a suspension member which is secured to a support line on substantially the opposite side of the hookah from the hookah hose, above said support panel.

14. The hookah suspension assembly of claim 1, wherein said support lines comprise one of: braided ropes and chains.

15. The hookah suspension assembly of claim 1, additionally comprising at least one fiber optic filament extending along at least one of said support lines and connected to a light source which can project light through and illuminate said at least one fiber optic filament.

16. The hookah suspension assembly of claim 15, wherein said at least one fiber optic filament is braided into one of said support lines.

17. The hookah suspension assembly of claim 15, wherein said light source is a control box fastened to said support panel.

18. The hookah suspension assembly of claim 1, wherein at least one of said support lines is a fiber optic filament.

* * * * *